United States Patent [19]

Lebowitz et al.

[11] 4,396,488

[45] Aug. 2, 1983

[54] PROCESS FOR COAL LIQUEFACTION EMPLOYING A SUPERIOR COAL LIQUEFACTION PROCESS SOLVENT

[75] Inventors: Howard E. Lebowitz, Mountain View; Norman C. Stewart, San Jose, both of Calif.; William H. Weber, Helena, Ala.

[73] Assignee: Electric Power Research Institute, Inc., Palo Alto, Calif.

[21] Appl. No.: 309,592

[22] Filed: Oct. 8, 1981

[51] Int. Cl.[3] ..... C10G 1/00

[52] U.S. Cl. ..... 208/8 LE

[58] Field of Search ..... 208/8 LE

[56] References Cited

U.S. PATENT DOCUMENTS

| | | | |
|---|---|---|---|
| 3,892,654 | 7/1975 | Wright et al. | 208/8 LE |
| 4,162,956 | 7/1979 | Rhodes | 208/8 LE |
| 4,164,466 | 8/1979 | Baldwin et al. | 208/177 |
| 4,300,996 | 11/1981 | Kuehler | 208/10 |
| 4,330,389 | 5/1982 | Rosenthal et al. | 208/10 |

*Primary Examiner*—Delbert E. Gantz
*Assistant Examiner*—William G. Wright
*Attorney, Agent, or Firm*—William G. Addison

[57] ABSTRACT

A process for producing a superior coal liquefaction solvent. A particulate coal is admixed with a distillable aromatic hydrocarbon solvent and liquefied under predetermined conditions to form coal liquefaction products comprising distillable and substantially nondistillable soluble coal products and insoluble coal products. The distillable solvent and distillable soluble coal products are separated from the remaining liquefaction products. The remainder is admixed with a deashing solvent and separated under elevated temperature and pressure conditions in several separation zones into an insoluble coal products fraction, a light soluble coal products fraction and a heavy soluble coal products fraction. A portion of the light soluble coal products fraction is admixed with the recovered distillable solvent to form the coal liquefaction solvent. The light soluble coal products comprise at least about 15 percent and preferably 25 to 50 percent of the coal liquefaction solvent.

16 Claims, 2 Drawing Figures

PROCESS FOR COAL LIQUEFACTION EMPLOYING A SUPERIOR COAL LIQUEFACTION PROCESS SOLVENT

BACKGROUND OF THE INVENTION

1. Field of the Invention

The present invention provides a process for the production of a superior solvent for use in a coal liquefaction process.

2. Brief Description of the Prior Art

In conventional coal liquefaction processes, particulate coal is treated at an elevated temperature and pressure in the presence of a hydrogen-donor solvent and hydrogen gas in order to remove the mineral matter, lower the sulfur content of the coal and convert the coal into liquid and low melting temperature solid products. These products also can be upgraded through catalytic hydrogenation to produce higher quality liquids.

Presently, little is known of the exact mechanisms by which the coal is transformed into soluble form or of the detailed chemical structure of the soluble coal products. It is known that many coals are easily solubilized and for others solubilization is more difficult. Some correlations have been made between the rank of the coal and ease of the solubilization and product yield. Little is known about the relationships to product quality.

The initial products produced by a coal liquefaction process may have utility as a substitute clean fuel or boiler fuel. However, for substitute fuels of higher quality, specifications on viscosity, melting point, ash, hydrogen and sulfur contents are much more stringent. Attempts to meet these specifications by operating the coal liquefaction process under more severe operating conditions have met with many difficulties. For example, the processes have experienced low liquid yields, high hydrogen consumption, difficulty of separating unreacted residue and excessive char formation which often completely plugs process transfer lines and reactors.

Alternative methods of improving product specifications through catalytic hydrogenation also are difficult. The problems which arise include: (i) a susceptibility of the liquefaction products to polymerize and deposit as coke on catalyst used for their conversion; (ii) fouling of catalyst by physical blockage as the molecular size of the coal liquefaction products approach the pore size of conventional catalysts; and (iii) catalyst contamination by metal contaminants or other nitrogenous and sulfur compounds contained in the coal liquefaction products.

In the process of converting the coal to liquid and low sulfur, low melting temperature solids, several reaction steps occur. Generally, the coal is admixed with a suitable solvent and hydrogen and the admixture is passed through a preheater to raise the reactants to a desired reaction temperature and pressure. For bituminous coal, the coal is substantially dissolved by the time it exits the preheater. Subbituminous coals also can be dissolved, but care must be exercised not to raise the temperature level above that at which excessive charring occurs. The products exiting from the preheater then are transfered to a reactor where further conversion takes place to lower the heteroatom content of the dissolved coal to a specification sulfur content and melting point temperature. The products exiting the reactor initially are flashed. The flashing depressurizes the product stream and removes gases and light organic liquids. The remaining product stream then is distilled to recover the solvent and liquid products having a boiling point temperature similar to that of the solvent. The solvent and a sufficient quantity of the separated liquid products to supplant any solvent consumed or lost in the process are recycled. The liquefaction product remainder can be further treated to separate the liquefaction products into several fractions.

The precise chemical nature of the coal liquefaction products still are unknown. Generally, their composition is discussed in terms of solubility. Several classifications commonly are used, these include: (i) oils, which are organic compounds that are hexane or pentane soluble; (ii) asphaltenes, which are benzene soluble; and (iii) cresol soluble-benzene insoluble materials which often are referred to as preasphaltenes.

It is known that the composition of the liquids and solids produced during a coal liquefaction process depend not only upon the nominal process operating conditions such as temperature, pressure and residence time, but also upon the solvent employed. It is known that a "good" solvent reduces the production of preasphaltenes and increases the production of either or both oils and asphaltenes.

Whatever coal liquefaction process is employed to convert the coal to coal liquefaction products requires the use of an extraneous solvent for process start-up. This extraneous solvent is slowly replaced in the process by a coal-derived recycle solvent. It is desirable to provide a start-up solvent that will permit the production of an optimum coal derived product for subsequent use as process solvent. However, the selection and production of such a optimum start-up solvent is very difficult to achieve. It would be desirable to provide a means by which a start-up solvent can be produced which will permit production of a desired coal-derived recycle solvent stream.

SUMMARY OF THE INVENTION

The surprising discovery now has been made that the behavior of a coal liquefaction process ultimately is a function of the type of solvent used for process start-up. It has been found that an excellent solvent for use in the start-up of a coal liquefaction process results from reacting almost any aromatic hydrocarbon distillate having a boiling temperature in the range of from about 300° F. to about 950° F. with a substantially nondistillable soluble coal fraction produced from the coal liquefaction process when operating at predetermined conditions with the aromatic distillate. The substantially nondistillable soluble coal fraction is admixed with the distillate in an amount in excess of that necessary to replace the distillate solvent which is consumed or lost in the process and the admixture is recycled for use as solvent in the coal liquefaction process.

In operation, the aromatic distillate solvent is admixed with the coal and heated to a temperature in the range of from about 700° F. to about 800° F. at an elevated pressure in the presence of hydrogen gas to form liquefaction products. The liquefaction products are flashed and vacuum or atmospheric distilled to remove substantially all the distillable coal liquefaction products. The remainder, comprising substantially nondistillable soluble coal liquefaction products, then is fractionated, employing a selected deashing solvent at conditions near the critical conditions of the deashing solvent, into a light solvent refined coal fraction and a heavy solvent refined coal fraction. A portion of the light solvent refined coal fraction is admixed with the aromatic distillate solvent in an amount in excess of the quantity of solvent consumed or lost in the process. Normally, the light solvent refined coal will comprise in excess of 15% and preferably between 25 and 50 percent of the admixture for use as recycle solvent. After a suitable period of operation, the conditions of the coal liquefaction process then are adjusted to other desired operating conditions such as by increasing the temperature and reducing or eliminating the use of light solvent refined coal recycle. The resulting product yields are superior to those which are obtained when the process is started up using other start-up solvents and conditions.

DESCRIPTION OF THE PREFERRED EMBODIMENT

Figure 1:
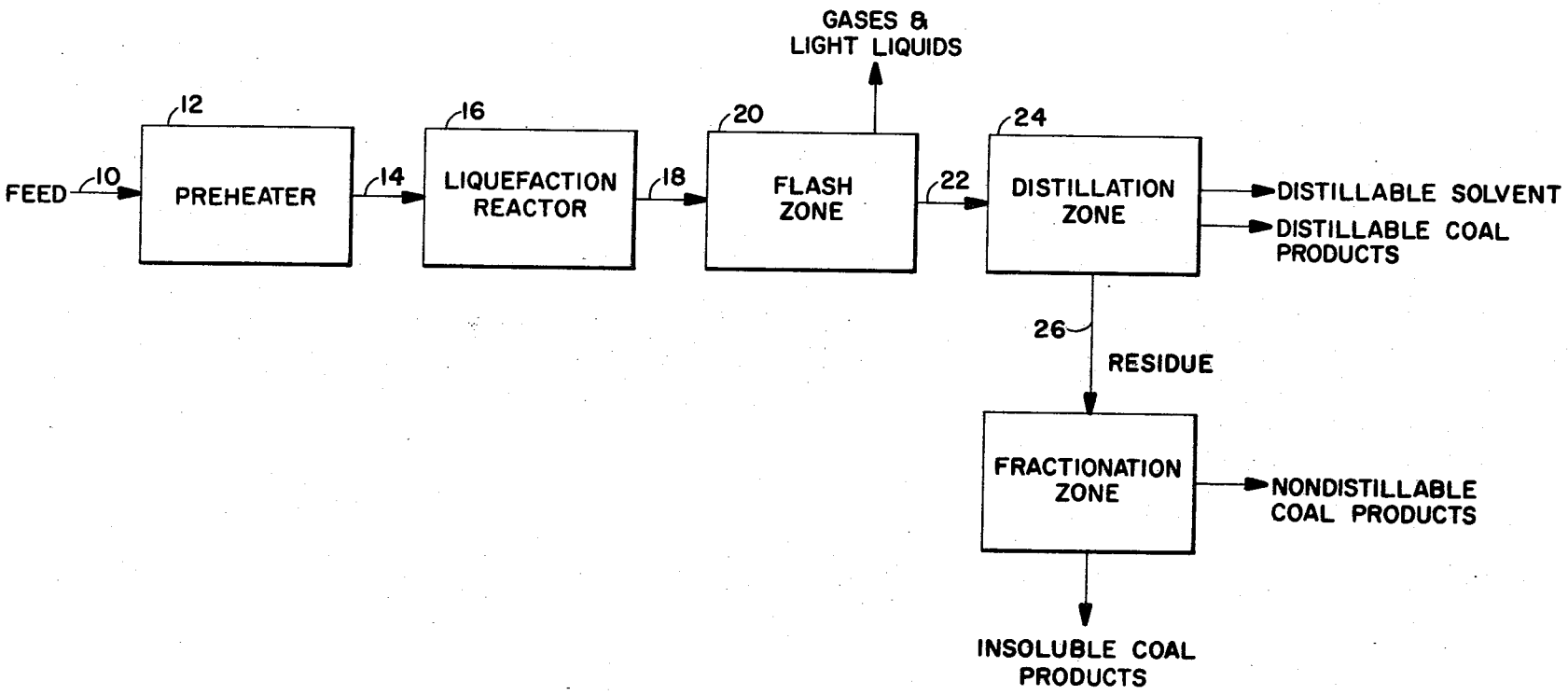
FIG. 1 is a diagrammatic, schematic illustration of a traditional coal liquefaction process.

Turning now to FIG. 1, in a traditional coal liquefaction process, a coal feed comprising bituminous coal, subbituminous coal or the like is admixed with a solvent to form a slurry. The solvent can comprise mixtures of aromatics, hydroaromatics, naphthentics, phenolics, quinolines and similar compounds which comprise the coal liquefaction product having a boiling point temperature in the range of from about 350° F. to about 1000° F. A suitable solvent for starting the process is the commercial product of coal pyrolysis generally known as creosote oil or anthrancene oil. Sufficient solvent is admixed with the coal to provide a ratio, by weight, of coal to solvent in the range of from about 1:1.2 to about 1:3. The slurry then is pressurized and introduced through a conduit 10 into a preheater 12 to heat the slurry to an elevated temperature at the elevated pressure. The preheated slurry then is passed through a conduit 14 and introduced into a liquefaction reactor 16 maintained at an elevated temperature and pressure. The temperature level normally is maintained in the range of from about 750° F. to about 1000° F. and preferably is maintained at about 800° F. to about 900° F. The pressure level normally is maintained in a range of from about 1000 psig. to about 5000 psig. and preferably from about 1000 psig. to about 2500 psig.

In reactor 16, the slurry undergoes conversion to form coal liquefaction products comprising soluble coal products and insoluble coal products in admixture with the solvent. Hydrogen gas, synthesis gas or the like can be introduced into the slurry prior to entry into the reactor or while within the reactor. The presence of this additional hydrogen aids in the conversion of the coal feed to provide a higher yield of coal liquefaction products.

The coal liquefaction products are withdrawn from reactor 16 through a conduit 18 and introduced into a flash zone 20. The coal liquefaction products are flashed to separate gases and light organic liquids. The flashed coal liquefaction products then are introduced into a distillation zone 24 through a conduit 22 and subjected to vacuum or atmospheric distillation to separate the distillable solvent and distillable soluble coal products. The residue comprises substantially nondistillable soluble coal products and insoluble coal products. The residue is withdrawn from distillation zone 24 through a conduit 26 and introduced into a fractionation zone 28. The residue is fractionated to permit separation of the substantially nondistillable coal products from the insoluble coal products.

Operation of the process under the previously defined conditions maximizes the yield of soluble coal products and particularly substantially nondistillable soluble coal products. The substantially nondistillable soluble coal products generally comprise a solid at ambient temperature and are a desirable high quality fuel for boilers and the like. In the process of converting the coal feed to such soluble coal products, a portion of the solvent is consumed or otherwise lost in the apparatus of the process. To permit continuous operation of the liquefaction process, a portion of the distillable soluble coal products produced in the process normally are recycled to supplant the lost solvent. Continued process operation eventually will result in the complete replacement of the original solvent with a process derived solvent. The quality or chemical nature of this process derived solvent is of critical importance in establishing the rate of reaction in the liquefaction reactor and plays a predominant role in controlling product selectivity. The rate of coal dissolution is responsive to the concentration of hydroaromatic hydrocarbons in the solvent. Thermally generated radicals produced from the coal must be combined with hydrogen to produce soluble specie. The solvent can act to provide the necessary hydrogen in various ways if the solvent contains sufficient labile hydroaromatics. The hydroaromatics can provide the majority of the hydrogen that is required. A high concentration of hydroaromatics in the solvent also results in rapid desulfurization and deoxygenation of the coal. If the quantity of the hydroaromatics is limited, phenols in the solvent provide hydrogen through alkylation reactions. Under some circumstances hydrogen gas present in the slurry with the solvent can directly react with the thermally generated coal radicals.

It has been found that continuous operation of a coal liquefaction process in a traditional manner with a distillable process derived solvent results in a gradual reduction in conversion efficiency because of a decrease in the quality of the solvent separated from the coal liquefaction products. It has been found that aromatic methyl compounds and alkyl aliphatics are formed within the process and these compounds are separated and recycled as an integral part of the solvent. The presence of these compounds decreases the efficiency of the solvent and results in the production of an increased quantity of preasphaltenes and a reduction in production of the more desirable asphaltenes and oils.

The discovery has been made that the ultimate behavior of the coal liquefaction process is a function of the type of solvent used for process start-up. While this initial solvent is displaced by a process derived product fraction, the nature of this replacement solvent is at least in part determined by the start-up solvent. The production of a superior solvent for process start-up results in an improved conversion of the coal and provides benefits which remain even after substantial periods of continuous operation of the coal liquefaction process under traditional operating methods.

Figure 2:
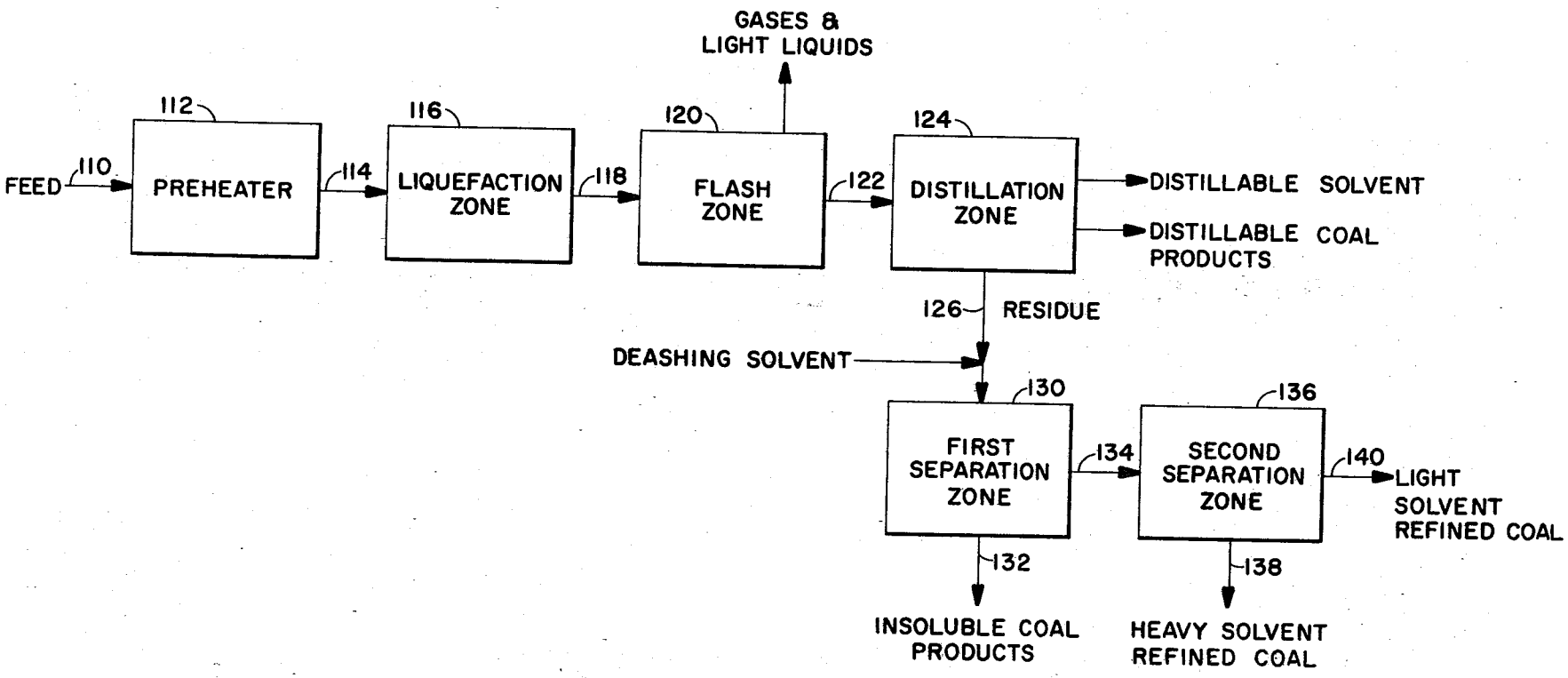
FIG. 2 is a diagrammatic, schematic illustration of the process of the present invention.

The discovery has been made that a superior start-up solvent can be produced by the following process. Turning now to FIG. 2, a coal feed is admixed with a distillable aromatic hydrocarbon solvent having a boiling temperature in the range of from about 300° F. to about 950° F. to form a slurry. Sufficient solvent is admixed with the coal to provide a coal to solvent ratio, by weight, in the range of from about 1:1.3 to about 1:3. The slurry then is pressurized and introduced through a conduit 110 into a preheater 112 wherein it is heated to an elevated temperature. The preheated slurry then is introduced through a conduit 114 into a liquefaction reactor 116 maintained at a temperature level of from about 700° F. to about 800° F. Preferably, the liquefaction reactor is maintained at a temperature level in the range of from about 725° F. to about 775° F. The hydrogen partial pressure level in the liquefaction reactor is maintained in the range of from about 1000 psia to about 2500 psia and preferably is maintained in a range of from about 1000 psia to about 1500 psia. Preferably, hydrogen gas, synthesis gas or the like is introduced into the liquefaction reactor together with the slurry. The coal is converted to coal liquefaction products within reactor 116.

The coal liquefaction products produced in liquefaction reactor 116 are flashed and subjected to vacuum or atmospheric distillation to separate the distillables in a flash zone 120 and a distillation zone 124, respectively. The residue, comprising substantially nondistillable soluble coal products and insoluble coal products, is withdrawn through a conduit 126 and admixed with a deashing solvent introduced through a conduit 128 to form a prepared mixture which is introduced into a first separation zone 130. Sufficient deashing solvent is admixed with the residue to provide a ratio by weight of coal liquefaction products to deashing solvent in the prepared mixture in the range of from about 1:1 to about 1:10. It is to be understood that larger quantities of the deashing solvent may be employed, however, such larger quantities generally are unnecessary.

The first separation zone 130 is maintained at a temperature level in the range of from about 400° F. to about 700° F. and a pressure level in the range of from about 600 psig. to about 1500 psig. to effect a separation of the prepared mixture. The prepared mixture is caused to separate into a first light phase comprising deashing solvent and the substantially nondistillable soluble coal products and a first heavy phase comprising insoluble coal products and some deashing solvent.

The first heavy phase is withdrawn from first separation zone 130 through a conduit 132 and can be treated by flashing or the like to separate the deashing solvent from the insoluble coal products. The separated deashing solvent then can be recycled in the process.

The first light phase is withdrawn from first separation zone 130 through a conduit 134 and is introduced into a second separation zone 136. An additional quantity of deashing solvent can be admixed with the first light phase, if desired, to facilitate the subsequent fractionation of the soluble coal products that are present.

The second separation zone 136 is maintained at a temperature level in the range of from about 450° F. to about 800° F. and a pressure level in the range of from about 400 psig. to about 1500 psig. The heating of the first light phase to the temperature of second separation zone 136 can be achieved, for example, by passage through a heater.

The particular temperature and pressure conditions in second separation zone 136 are selected to provide a differential in the deashing solvent density existing within first separation zone 130 and second separation zone 136 sufficiently large to cause the first light phase to separate into a second light phase and a second heavy phase. The second light phase comprises deashing solvent and light soluble coal products. The second heavy phase comprises heavy soluble coal products and some deashing solvent.

The second heavy phase is withdrawn from second separation zone 136 through a conduit 138 and treated to recover the deashing solvent, for example, by flashing to produce one stream comprising deashing solvent and another stream comprising the remainder of the second heavy phase now referred to as a heavy solvent refined coal fraction. This heavy solvent refined coal fraction, upon cooling to about ambient temperature, will form a low melting temperature solid suitable for use as fuel, for example, to a boiler.

The second light phase is withdrawn from second separation zone 136 through a conduit 140 and treated to separate the deashing solvent, for example, by flashing to produce at least one stream comprising deashing solvent and one other stream comprising at least a portion of the light soluble coal products now referred to as light solvent refined coal.

A portion of the light solvent refined coal is admixed with the distillable solvent separated from the coal liquefaction products to provide a solvent stream for recycle in the coal liquefaction process. The light solvent refined coal is admixed with the distillable solvent in a sufficient quantity to comprise at least about 15 percent of the admixture and preferably between 25 and 50 percent of the admixture. This admixture then is recycled to the coal liquefaction process. In any event, the quantity of light solvent refined coal admixed with the distillable solvent is in excess of the quantity of distillable solvent that is consumed or lost in the process, including that which was allowed to remain in the distillation residue fed to the deashing and fractionation step. The coal liquefaction process now can be operated under traditional operating conditions with recycle of additional quantities of distillable soluble coal products or light solvent refined coal being limited to only that quantity necessary to replace distillable solvent which remains in the coal liquefaction products after distillation of the solvent for recycle in the process. The beneficial effects which the recycled light solvent refined coal in the solvent have upon the conversion of the coal to benzene soluble products remain substantially unchanged when the liquefaction process is operated under traditional operating conditions. The solvent lost in the traditional process can be replenished by use of a portion of the distillable products produced by the liquefaction process without a detrimental effect upon the quality of the solvent.

To further illustrate the process of this invention, and not by way of limitation, the following examples are provided.

Example I

A traditional coal liquefaction is performed in which particulate Kentucky No. 9 coal is admixed with a hydrocarbon distillate solvent comprising anthracene oil having a boiling point temperature range of from about 400° F. to about 1000° F. in a coal to solvent ratio of about 1:2, by weight. The slurry thus formed is pressurized, preheated and introduced into a liquefaction reactor together with hydrogen gas. The temperature in the reactor is maintained at about 840° F. The hydrogen gas exit pressure from the reactor is about 1000 psig. The feed rate of the slurry to the reactor is about 40 lbs. of coal/hr-ft$^3$. The reactor effluent is flashed and vacuum distilled to separate the distillates and recover the solvent for recycle. The yield of ash free vacuum residuum was 53 percent of the MAF coal feed of which 78 to 80 percent was recovered in subsequent deashing steps.

A portion of the recycle solvent is analyzed to measure the solvent quality. Solvent quality is measured by the following empirical test that measures coal conversion in relation to the quantity of hydrogen donors present in the solvent.

A sample of a standard coal is admixed with a quantity of the recycle solvent in a ratio by weight of coal to solvent in a ratio by weight of coal to solvent of 1:8. This mixture is introduced into a microautoclave comprising a 30 ml. stainless steel pipe bomb. Several stainless steel ball bearings are placed in the microautoclave to ensure maximum mixing. The microautoclave then is connected to a vertical shaking apparatus capable of agitating the mixture at a rate of 1000 strokes per minute. The stroke length is about 1 inch. The microautoclave then is immersed in a preheated fluidized sand bath for 10 minutes. The microautoclave is heated to a temperature of 750° F. within the sand bath in less than about 90 seconds. Upon removal from the sand bath the microautoclave rapidly is cooled to ambient temperature by immersion in a coal water bath.

The microautoclave contents then are washed from the microautoclave with tetrahydrofuran and filtered under nitrogen gas at a pressure of 5–10 psig. through Whatman #42 filter paper. The filter cake is washed with additional quantities of tetrahydrofuran until the filtrate is colorless. The filter cake is dried and weighed to determine the combined weight of ash and unconverted coal. This data and the proximate analysis of the coal then is employed to calculate the yield of soluble coal products.

The activity of the solvent is defined as the conversion of the standard coal sample to tetrahydrofuran solubles. The activity of the recycle solvent produced by the traditional coal liquefaction method is about 69 percent.

EXAMPLE II

In accordance with the process of the present invention, particulate Kentucky No. 9 coal is admixed with a solvent similar to that of Example I having a boiling point temperature range of from about 400° F. to about 1000° F. in a coal to solvent ratio of about 1:2, by weight. The slurry thus formed is pressurized, preheated and introduced into a liquefaction reactor together with hydrogen gas. The temperature in the reactor is maintained at about 780° F. The hydrogen gas exit pressure from the reactor is about 1000 psig. The feed rate of the slurry to the reactor is about 33 lbs. of coal/hr-ft$^3$. The reactor effluent, comprising coal liquefaction products, is flashed and vacuum distilled to separate the distillates and recover the solvent for recycle.

The liquefaction product residue remaining after distillation of the distillable soluble coal products is admixed with a deashing solvent comprising an aromatic hydrocarbon fraction having a boiling temperature in the range of from about 175° F. to about 300° F. The liquefaction product to deashing solvent ratio is about 1:28, by weight. The admixture is introduced into a first separation zone maintained at a temperature level in the range of about 550° F. to about 580° F. and a pressure of about 880 psig. The admixture separates into a first light phase and a first heavy phase. The first light phase is introduced into a second separation zone. The second separation zone is maintained at a temperature level in the range of from about 670° F. to about 680° F. and a pressure of about 850 psig. The first light phase separates into a second light phase comprising light soluble coal products and deashing solvent and a second heavy phase. The second light phase is withdrawn from the second separation zone and flashed to separate the solvent and leave a light solvent refined coal fraction. A portion of the light solvent refined coal is admixed with the distillable solvent to form a solvent comprising about 30 weight percent light solvent refined coal. The solvent quality is analyzed by the previously described empirical test and is found to have an activity of about 80 percent. This solvent then is admixed with particulate Kentucky No. 9 coal in a ratio of coal to solvent of 1:2 to form a slurry. The slurry is pressurized, preheated and introduced into a reactor together with hydrogen gas as in Example I. The temperature in the reactor is maintained at about 840° F. The hydrogen gas exit pressure from the reactor is about 1000 psig. The feed rate of the slurry to the reactor is about 40 lbs of coal/hr-ft$^3$. The reactor effluent is flashed and vacuum distilled to separate the distillable coal liquefaction products and solvent. The distillables are fractionated to separate the solvent fraction having a boiling temperature in the range of from about 400° F. to about 1000° F. from the remaining distillables. The substantially nondistillable residue is admixed with a deashing solvent comprising an aromatic hydrocarbon fraction having a boiling temperature in the range of from about 175° F. to about 300° F. in a ratio of coal liquefaction products to deashing solvent of about 1:26, by weight. The admixture is introduced into a first separation zone maintained at a temperature level in the range of from about 550° F. to about 560° F. and a pressure of about 825 psig. The admixture separates into a first light phase and a first heavy phase. The first light phase is introduced into a second separation zone maintained at a temperature level in the range of from about 660° F. to about 670° F. and a pressure of about 805 psig. The first light phase separates into a second light phase and a second heavy. The second light phase is flashed to separate the deashing solvent and recover the light solvent refined coal. Sufficient light solvent refined coal is admixed with the distillable solvent, if necessary, to replace any solvent not recovered from the liquefaction reactor effluent and the solvent is recycled in the process which is continuously operated for about 30 days. The yield of ash free vacuum residuum products is about 56 percent of the moisture and ash free coal feed. About 85 to 88 percent of which was recovered in a subsequent deashing step. A sample of the recycle solvent then is analyzed by the previously described empirical test and is found to have an activity of about 80 percent.

The benefits that derive from practice of the process of the present invention clearly are illustrated by the improvement in the solvent quality of the coal liquefaction process when operated under traditional operating conditions and improved product recovery.

The term "deashing solvent" a used herein refers to those solvents consisting essentially of at least one substance having a critical temperature below 800 degrees F. selected from the group consisting of: aromatic hydrocarbons having a single benzene nucleus and normal boiling points below about 310 degrees F., such as benzene, toluene, o-, m- and p-xylene, ethyl benzene, isopropyl benzene and monocyclic aromatic hydrocarbons in general having normal boiling points below about 310 degrees F.; cycloparaffin hydrocarbons having normal boiling points below about 310 degrees F., such as cyclobutane, cyclopentane, cyclohexane, cycloheptane and nonaromatic monocyclic hydrocarbons in general having normal boiling points below about 310 degrees F.; open chain mono-olefin hydrocarbons having normal boiling points below about 310 degrees F., such as butene, pentene, hexene and heptene; open chain saturated hydrocarbons having normal boiling points below about 310 degrees F., such as pentane, hexane and heptane; mono-, di, and tri-open chain amines containing from about 2–8 carbon atoms, such as ethyl, propyl, butyl, pentyl, hexyl, heptyl, and octyl amines; carbocyclic amines having a monocyclic structure containing from about 6–9 carbon atoms, such as aniline and its alkyl homologs; heterocyclic amines containing from about 5–9 carbon atoms, such as pyridine and its alkyl homologs; and phenols containing from about 6–9 carbon atoms and their homologs.

The term "insoluble coal product" as used herein refers to the undissolved coal, mineral matter, other solid inorganic particulate matter and other such matter which is insoluble in the process solvent and deashing solvent under the conditions of the process of this invention. The term "soluble coal product" as used herein refers to the constituent fractions in the coal which are soluble in the liquefaction process solvent and deashing solvent. The term "distillable soluble coal product" as used herein refers to the constituent fractions of the soluble coal product having a boiling point temperature below about 1050° F. The term "substantially nondistillable soluble coal product" as used herein refers to the constituent fractions of the soluble coal product having an initial boiling point temperature above about 1050° F. The term "light soluble coal product" or "light solvent refined coal" as used herein refers to those fractions of the soluble coal product having a density less than the average density of the soluble coal product introduced as feed into a designated separation zone. The term "heavy soluble coal product" or "heavy solvent refined coal" as used herein refers to those fractions of the soluble coal product having a density greater than the average density of the soluble coal product introduced as feed into a designated separation zone.

While the subject invention has been described with regard to what is considered to be the preferred embodiment thereof, it is to be understood that changes or modifications can be made in the process disclosed without departing from the spirit or scope of the invention as defined by the following claims.

What is claimed is:

1. A process for coal liquefaction employing a superior coal liquefaction solvent comprising:

admixing a first portion of particulate coal with a distillable aromatic hydrocarbon solvent having a boiling temperature in the range of from about 300° F. to about 950° F. to form a slurry;

heating the slurry to a temperature level in the range of from about 700° F. to about 800° F. in the presence of hydrogen gas while maintaining the slurry at a pressure in the range of from about 1000 psig. to about 2500 psig. to effect a conversion of the coal in the slurry to coal liquefaction products comprising distillable and substantially nondistillable soluble coal products and insoluble coal products in admixture with the distillable aromatic hydrocarbon solvent;

distilling said coal liquefaction products to separate said distillable aromatic hydrocarbon solvent and distillable soluble coal products from the remainder;

admixing the remainder with a deashing solvent to form a prepared mixture;

separating said prepared mixture into a first light phase and a first heavy phase comprising insoluble coal products and some deashing solvent by maintaining the prepared mixture at a first temperature level in the range of from about 400° F. to 700° F. and a pressure in the range of from about 600 psig. to about 1500 psig.;

heating said first light phase to a second temperature level higher than the first temperature level while maintaining the pressure in the range of from about 600 psig. to about 1500 psig. to effect a separation of said first light phase into a second light phase comprising light solvent refined coal and deashing solvent and a second heavy phase comprising heavy solvent refined coal and some deashing solvent;

recovering the light solvent refined coal from the second light phase;

admixing a portion of the light solvent refined coal with the distillable aromatic hydrocarbon solvent recovered from admixture with the coal liquefaction products to form a coal liquefaction solvent, said light solvent refined coal comprising at least 15 percent by weight of said coal liquefaction solvent; and contacting said coal liquefaction solvent with a second portion of particulate coal at a temperature in excess of about 800° F. and a pressure in excess of about 1000 psig. to effect a conversion of said particulate coal to coal liquefaction products comprising distillable and substantially nondistillable soluble coal products and insoluble coal products in admixture with said coal liquefaction solvent.

2. The process of claim 1 wherein the ratio of coal to distillable aromatic hydrocarbon in said slurry is in the range of from about 1:2 to about 1:10.

3. The process of claim 1 wherein said deashing solvent consists essentially of at least one substance having a critical temperature below 800 degrees F. selected from the group consisting of aromatic hydrocarbons having a single benzene nucleus and normal boiling points below about 310 degrees F., cycloparaffin hydrocarbons having normal boiling points below about 310 degrees F., open chain mono-olefin hydrocarbons having normal boiling points below about 310 degrees F., open chain saturated hydrocarbons having normal boiling points below about 310 degrees F., mono-, di, and triopen chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs.

4. The process of claim 1 wherein said light solvent refined coal comprises from about 25 to 50 percent by weight of said coal liquefaction solvent.

5. The process of claim 1 wherein said second temperature level is in the range of from about 450° F. to about 800° F.

6. The process of claim 1, further comprising:

contacting coal liquefaction solvent with an additional portion of particulate coal, at a temperature in excess of about 800° F. and a pressure in excess of about 1000 psig., to effect a conversion of said particulate coal to coal liquefaction products comprising distillable and substantially nondistillable soluble coal products and insoluble coal products in admixture with said coal liquefaction solvent; and wherein the coal liquefaction solvent contacting said additional portion comprises distillable coal products and aromatic hydrocarbon solvent, and no more than that quantity of light solvent refined coal necessary to replace distillables consumed in the process.

7. A process for coal liquefaction employing a superior coal liquefaction solvent comprising:

admixing a first portion of particulate coal with a distillable aromatic hydrocarbon solvent to form a slurry;

introducing hydrogen gas into said slurry to elevate the pressure level of said slurry;

heating said elevated pressure slurry to an elevated temperature to effect a conversion of said slurry into coal liquefaction products comprising distillable and substantially nondistillable soluble coal products and insoluble coal products in admixture with the distillable aromatic hydrocarbon solvent and hydrogen gas;

degassing said coal liquefaction products;

distilling said coal liquefaction products to separate said distillable aromatic hydrocarbon solvent and distillable soluble coal products from the remainder;

admixing said remainder with a deashing solvent to form a prepared mixture;

separating said prepared mixture in a first separation zone into a first light phase comprising substantially nondistillable soluble coal products and deashing solvent and a first heavy phase comprising insoluble coal products and some deashing solvent by maintaining said first separation zone at a temperature level in the range of from about 400° F. to about 700° F. and a pressure in the range of from about 600 psig. to about 1500 psig.;

introducing said first light phase into a second separation zone maintained at a temperature level above that maintained in said first separation zone and at substantially the same pressure level to effect a separation of said first light phase into a second light phase comprising light solvent refined coal and deashing solvent and a second heavy phase comprising heavy solvent refined coal and some deashing solvent;

recovering said light solvent refined coal from said second light phase;

admixing a portion of said light solvent refined coal with said distillable aromatic hydrocarbon solvent to form a coal liquefaction solvent, said light/solvent refined coal comprising at least about 15 percent by weight of said coal liquefaction solvent; and contacting said coal liquefaction solvent with a second portion of particulate coal at a temperature in excess of about 800° F. and a pressure in excess of about 1000 psig. to effect a conversion of said particulate coal to coal liquefaction products comprising distillable and substantially nondistillable soluble coal products and insoluble coal products in admixture with said coal liquefaction solvent.

8. The process of claim 7 wherein the elevated pressure level of the slurry is in the range of from about 1000 psig. to about 2500 psig.

9. The process of claim 7 wherein the elevated pressure slurry is heated to a temperature in the range of from about 700° F. to about 800° F.

10. The process of claim 7 wherein the elevated pressure slurry is heated to a temperature in the range of from about 725° F. to about 775° F.

11. The process of claim 7 wherein the ratio of coal to distillable aromatic hydrocarbon in said slurry is in the range of from about 1:2 to about 1:10.

12. The process of claim 7 wherein said deashing solvent consists essentially of at least one substance having a critical temperature below 800 degrees F. selected from the group consisting of aromatic hydrocarbons having a single benzene nucleus and normal boiling points below about 310 degrees F., cycloparaffin hydrocarbons having normal boiling points below about 310 degrees F., open chain mono-olefin hydrocarbons having normal boiling points below about 310 degrees F., open chain saturated hydrocarbons having normal boiling points below about 310 degrees F., mono-, di, and triopen chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs.

13. The process of claim 7 wherein said light solvent refined coal comprises from about 25 to 50 percent by weight of said coal liquefaction solvent.

14. The process of claim 7 wherein the temperature in the second separation zone is maintained in the range of from about 450° F. to about 800° F.

15. The process of claim 7 wherein said distillable aromatic hydrocarbon solvent comprises an aromatic hydrocarbon having a boiling point temperature in the range of from about 300° F. to about 950° F.

16. The process of claim 7, further comprising:

contacting coal liquefaction solvent with an additional portion of particulate coal, at a temperature in excess of about 800° F. and a pressure in excess of about 1000 psig., to effect a conversion of said particulate coal to coal liquefaction products comprising distillable and substantially nondistillable soluble coal products and insoluble coal products in admixture with said coal liquefaction solvent; and wherein the coal liquefaction solvent contacting said additional portion comprises distillable coal products and aromatic hydrocarbon solvent, and no more than that quantity of light solvent refined coal necessary to replace distillables consumed in the process.

* * * * *